US006219371B1

(12) United States Patent
Pavlicevic et al.

(10) Patent No.: US 6,219,371 B1
(45) Date of Patent: Apr. 17, 2001

(54) SYSTEM TO PLUG THE DELTA AREA OF THE ROOF OF AN ELECTRIC ARC FURNACE

(75) Inventors: Milorad Pavlicevic, Udine (IT); Peter Tishchenko, Donezk (UA); Alfredo Poloni, Fogliano Di Redipuglia; Angelico Della Negra, Povoletto, both of (IT)

(73) Assignee: Danieli & C. Officine Meccaniche SpA, Buttrio (UD) (IT)

( * ) Notice: Subject to any disclaimer, the term of this patent is extended or adjusted under 35 U.S.C. 154(b) by 0 days.

(21) Appl. No.: 09/482,942

(22) Filed: Jan. 14, 2000

(30) Foreign Application Priority Data

Jan. 20, 1999 (IT) ..... UD99A0014

(51) Int. Cl.[7] ..... F27D 1/02

(52) U.S. Cl. ..... 373/73; 373/9; 373/74; 266/158

(58) Field of Search ..... 373/71, 73, 74, 373/77, 2, 8, 9, 80; 266/45, 46, 158; 432/237

(56) References Cited

U.S. PATENT DOCUMENTS 4,371,970 * 2/1983 Guilpain et al. ..... 373/74
4,445,220 * 4/1984 Kuhlmann ..... 373/74
4,649,807 * 3/1987 Aasen et al. ..... 373/9
4,720,837 * 1/1988 Kanada ..... 373/9
5,787,108 * 7/1998 Pavlicevic et al. ..... 373/9

FOREIGN PATENT DOCUMENTS 4224845 2/1994 (DE) .
19729317 1/1999 (DE) .
0714007 5/1996 (EP) .
0805327 11/1997 (EP) .

* cited by examiner

*Primary Examiner*—Tu Ba Hoang
(74) *Attorney, Agent, or Firm*—Stevens, Davis, Miller & Mosher, LLP

(57) ABSTRACT

System to plug the roof of an electric arc furnace having a main chamber or melting volume arranged below the roof and at least one electrode introduced into the main chamber, the system comprising an upper element or auxiliary roof element arranged on the top of the roof and shaped so as to define an inner chamber and at least a central aperture through which the electrode can be moved, the auxiliary roof element consisting of a plurality of pipes inside which a cooling fluid circulates under pressure.

11 Claims, 4 Drawing Sheets

SYSTEM TO PLUG THE DELTA AREA OF THE ROOF OF AN ELECTRIC ARC FURNACE

FIELD OF THE INVENTION

The invention concerns a system to plug the delta of the roof of an electric arc furnace (EAF) used in steel works to melt iron materials or other metals.

To be more exact, the invention refers to a plugging system which prevents the fumes produced during the melting process from leaking from the hole or holes made in the roof through which the electrodes are inserted, and also to prevent the outside air from entering the central chamber of the furnace and interfering with the inner heat conditions.

BACKGROUND OF THE INVENTION

In the state of the art, the area of the roof of an electric arc furnace where the electrodes are positioned is known as the delta. It is achieved with a plugging element made of refractory material, with one or more holes to allow the electrodes to be inserted into the furnace.

The function of the plugging element is to prevent enormous quantities of fumes leaking from the furnace and to electrically insulate the electrodes from the cooled metal body which constitutes the structure of the roof.

There are two main problems in the state of the art, which limit the duration of the elements which make up the roof itself.

The first problem is that the high surface temperature which occurs on the refractory itself and which takes the refractory to partial melting and hence the plugging element is consumed.

The second problem is that metallic particles adhere on the surface of the central part of the roof. These semi-melted particles are transported by the fumes and adhere to the surface of the refractory element as they move upwards. This reduces the insulating capacity of the element. Moreover, when the furnace is working, the metal particles transported by the gases encourage ionisation thereof, creating working conditions suitable for the formation of micro-discharges between the electrodes and the refractory element itself. The higher the load of particles transported by the fumes, the more frequent and intense these micro-discharges are.

This phenomenon of wear takes the name of electro-erosion and is widely known to workers in this field.

Moreover, the holes produced in the plugging element for the insertion of the electrodes have a diameter suitably larger than that of the electrodes themselves, to prevent them from coming into direct contact. In order to prevent the fumes produced in the course of the melting process from leaking out through the interstices between the plugging element and the electrodes, in the surrounding area a slight depression is created in correspondence with the two. Therefore, there is a considerable inlet of air through these apertures from outside and to the melting volume, which interferes with the inner heating conditions and encourages the oxidation of the electrodes.

In many electric arc furnaces, where the power applied is very high (from 20MVA to 100MVA), it is necessary to increase the size of the gap between the wall of the hole and the corresponding electrode, and therefore there are frequent leakages of large quantities of fumes from the furnace, which are dangerous for the workers managing the plant and harmful for the work environment.

In applications of furnaces fed with Direct Current with two or more electrodes, there is also a deflection of the arcs towards the center of the furnace, due to the attraction between the two lines of current. This entails a direct radiance towards the refractory element and an intensification of the heat load thereon.

The present Applicant has devised, tested and embodied the plugging system according to the invention to solve all these disadvantages.

SUMMARY OF THE INVENTION

The present invention relates to a plugging system for electric arc furnaces.

One purpose of the invention is to achieve a plugging system for electric arc furnaces wherein the fumes produced by the melting metal do not leak from the aperture or apertures made on the top of the roof to allow the electrodes to be introduced, and wherein, at the same time, the outer air does not enter the main chamber of the furnace through the same apertures.

Another purpose of the invention is to achieve a plugging system which will prevent the formation of electric discharges onto the structure of the roof, due to the massive presence of ionised powders in the atmosphere of the furnace, and will also prevent the "sticking" of the metallic particles oh the refractory materials, which would entail an obvious reduction in the level of electric insulation.

In accordance with these purposes, the plugging system according to the invention comprises an upper element or auxiliary roof element consisting of a plurality of cooling pipes, arranged on the top of the main roof, shaped so as to define an inner chamber and provided with apertures through which the electrode or electrodes can be moved. The inner chamber of the auxiliary roof element is separated from the main chamber of the furnace by a cooling grid and is connected laterally to a vertical turret with a main aspiration function to create a vortex or cyclone effect at least around the upper part of each electrode.

BRIEF DESCRIPTION OF THE DRAWINGS

These and other characteristics of the invention will be clear from the following description of a preferred form of embodiment, given as a non-restrictive example, with the help of the attached drawings wherein.

DETAILED DESCRIPTION OF PREFERRED FORMS OF EMBODIMENT

Figure 1:
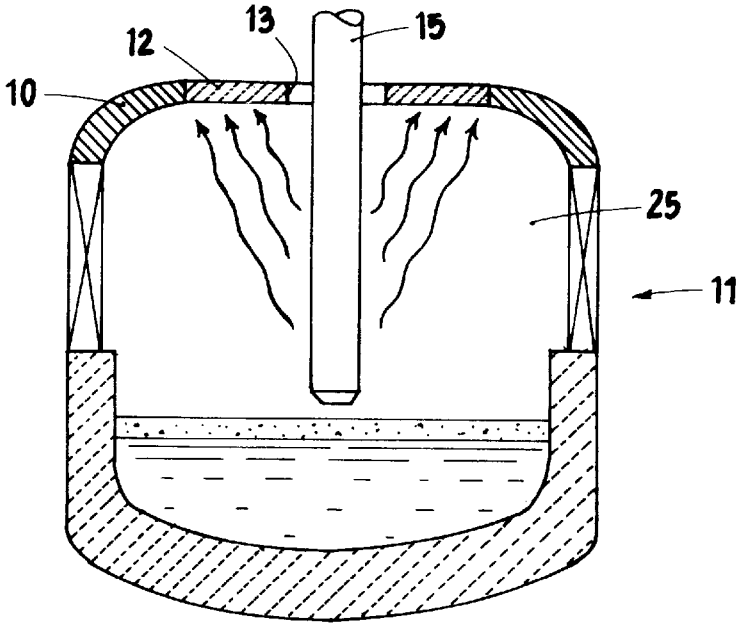
fig.1 (PRIOR ART)
FIG. 1 is a longitudinal section, in diagram form, of an electric arc furnace adopting a plugging system known to the state of the art.

FIG. 1 shows a plugging system for a roof 10 of an electric arc furnace 11 made according to the state of the art.

This system provides to use a plugging element 12 made of refractory material arranged on the top of the roof 10 and provided with one or more apertures or holes 13 which allow one or more electrodes 15 to be inserted into the furnace 11.

Figure 2:
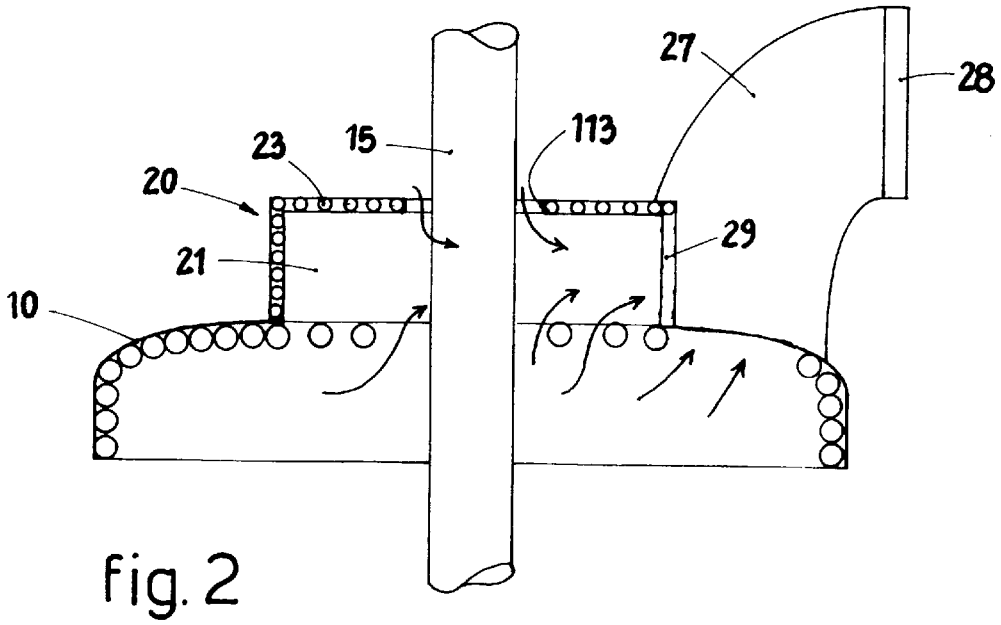
FIG. 2 is a longitudinal part section, in diagram form, of the roof of an electric arc furnace adopting the plugging system according to the invention.
Figure 3:
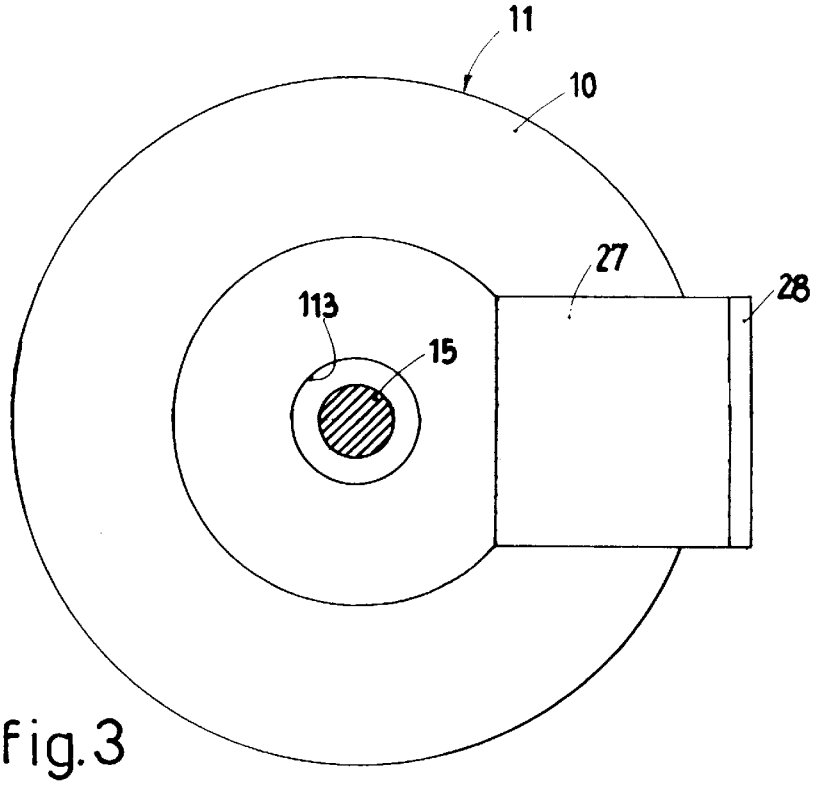
FIG. 3 is a view from above of the roof shown in FIG. 2.

In accordance with this invention, as shown in FIG. 2, an upper element or auxiliary roof element 20, shaped so as to define an inner chamber 21, is arranged on the top of the roof 10.

The auxiliary roof element 20 consists of a plurality of pipes 23 in which a cooling fluid, such as water for example, circulates under pressure, and is provided with apertures 113 through which the electrodes 15 can be moved.

The apertures 113, with the same diameter as the electrodes 15, are much bigger than the apertures 13 of the refractory elements 12, and such as to prevent the formation of discharges from the electrodes 15 onto the cooled pipes 23.

The chamber 21 is separated from the underlying main chamber 25 of the furnace 11 by a grid 26 of cooling pipes and is connected laterally, by means of an aperture or window 29 of appropriate size, to a vertical turret 27 with a main aspiration function, through which the fumes produced by the melting of the metal emerge.

A cyclone effect is created in the chamber 21 due to its shape and the fact that it is directly connected to the turret 27; this cyclone effect conveys the air arriving from the outside directly towards the turret 27, preventing the air from entering the main chamber 25. In a similar way, the fumes produced by the melting of the metal which enter the chamber 21 are discharged to the turret 27 and are not dispersed to the outside, through the apertures 113.

The turret 27 is provided with a side aperture 28, also known as the fourth hole, which is connected to an aspiration system of a known type and is not shown in the drawings. The aspiration system can be for example of the type described in the application for a patent of industrial invention n°. UD96A000066 filed by the present Applicant on Apr. 30, 1996.

The function of the aspiration system is to create a region of uniform aspiration in the roof of the furnace in order to reduce the speed at which the fumes are aspired with a vertical ascending motion up through the melting volume and at the same time to induce a rotatory movement of the fumes along their path towards the fourth hole 28, in order to perform a further filtering thereof.

Figure 4:
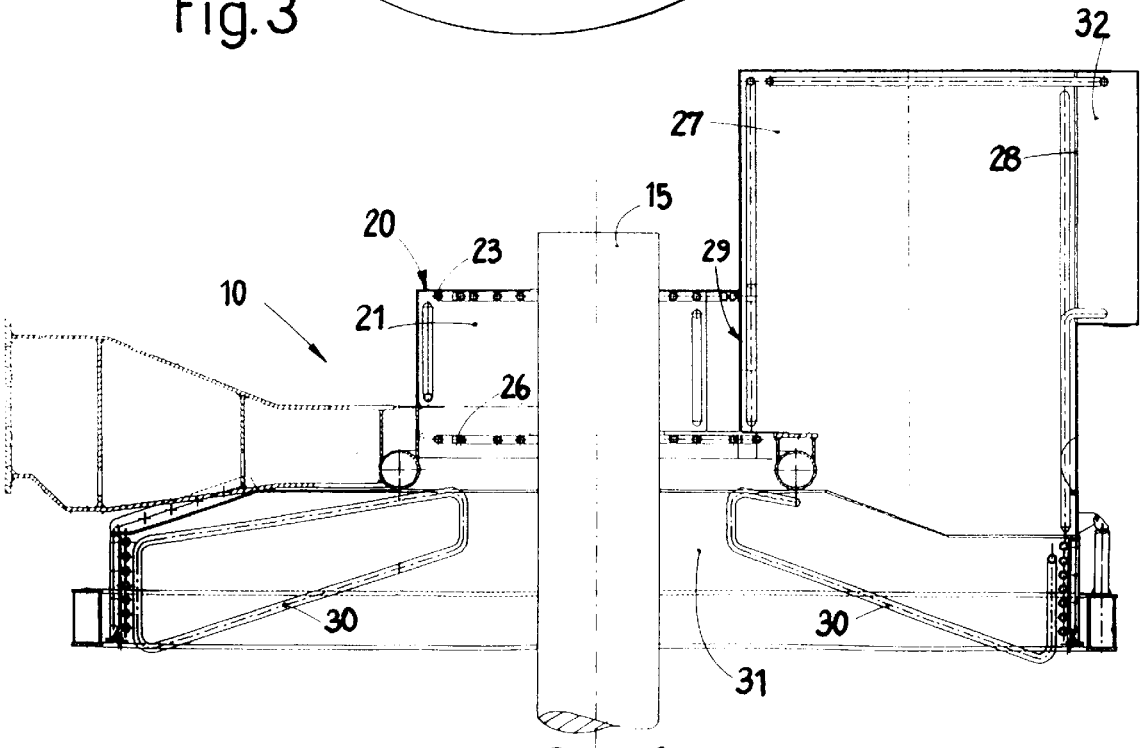
FIG. 4 is a longitudinal part section, in diagram form, of a variant of the plugging system shown in FIG. 2.

The plugging system also comprises a plurality of pipes 30 (FIG. 4) arranged in the upper part of the main chamber 25, in correspondence with the roof 10. Cooling fluid is also made to flow under pressure inside the pipes 30.

Figure 5:
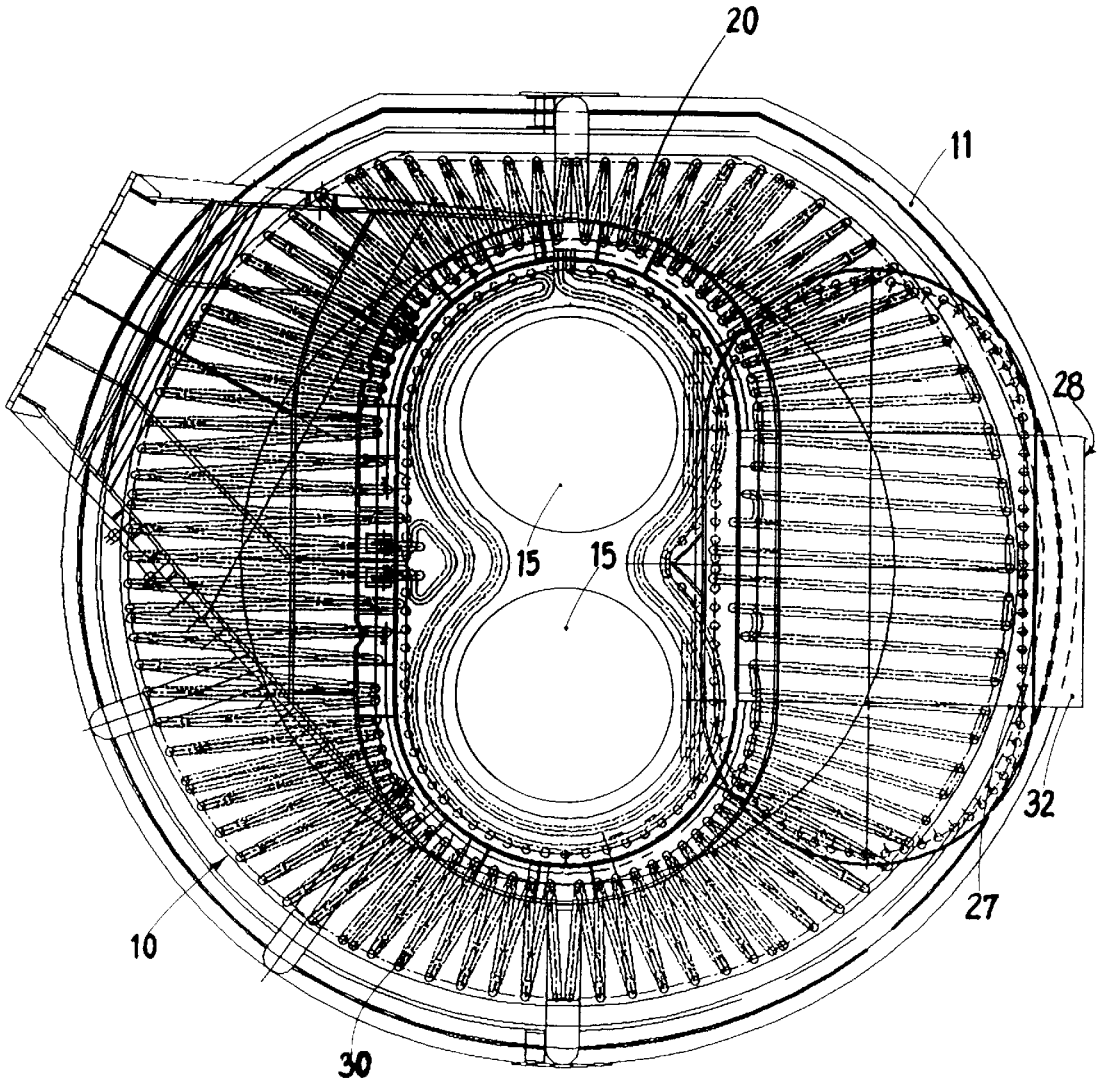
FIG. 5 is a view from above of the roof of a DC furnace with two electrodes adopting a plugging system according to the invention.

The pipes 30 are arranged in substantially radial spirals (FIG. 5) which define a circular crown arranged to almost totally cover the upper part of the central chamber 25, except for a central aperture 31 through which the electrodes 15 pass.

The spirals of the pipes 30 have a substantially trapezoid cross section (FIG. 4), except for those arranged in correspondence with the turret 27, which open upwards to allow the fumes to flow towards the latter.

The density of the spirals of the pipes 30 varies according to the zones of the roof 10, and is greater in correspondence with the turret 27, where the volume of the fumes is greatest and the prevalence of the aspiration is highest.

The grid 26 is shaped so as to conform to the outer profile of the electrodes 15.

To improve the yield of the electrodes 15 and increase their duration, a vortex or cyclone effect is created around them, so that the air and the fumes are discharged from the chamber 21 towards the turret 27 peripherally, far from the surface of the electrodes 15 themselves.

Figure 6:
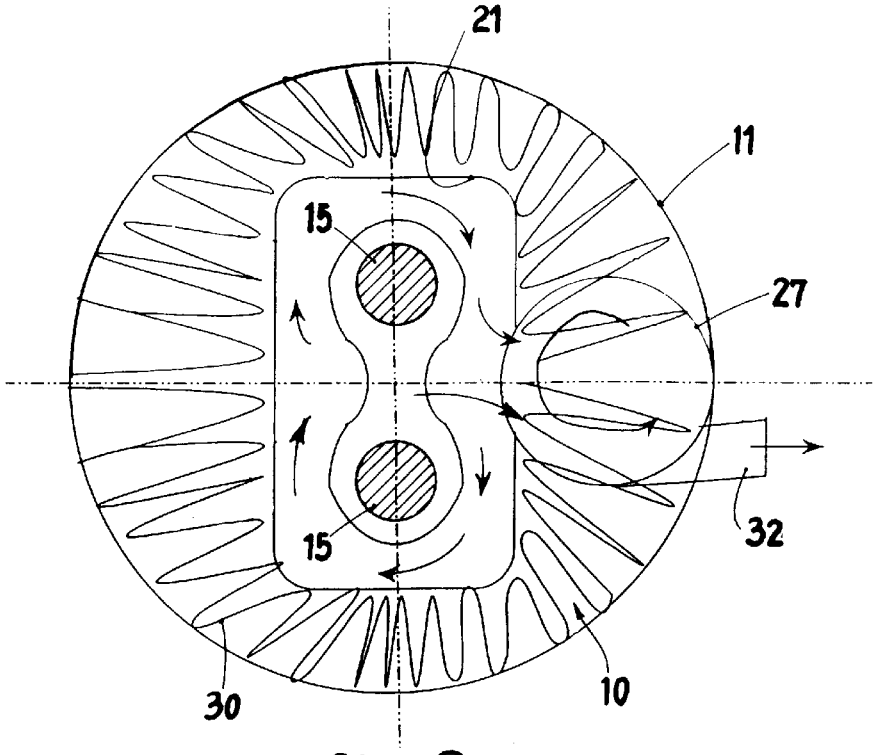
FIG. 6 is a view from above, in diagram form, of the upper part of the plugging system shown in FIG. 4 in a first form of embodiment.

According to a first form of embodiment, shown in FIG. 6, a single vortex of air is created around the electrodes 15, arranging the turret 27 in a substantially median position with respect thereto, with the relative outlet collector 32 arranged tangentially with respect to the turret 27, at its highest part. The turret 27 and the chamber 21 communicate by means of an aperture or duct 34 of an appropriately sized section. In FIG. 6 the arrows indicate the movement of the fumes before they exit from the furnace 11.

Figure 7:
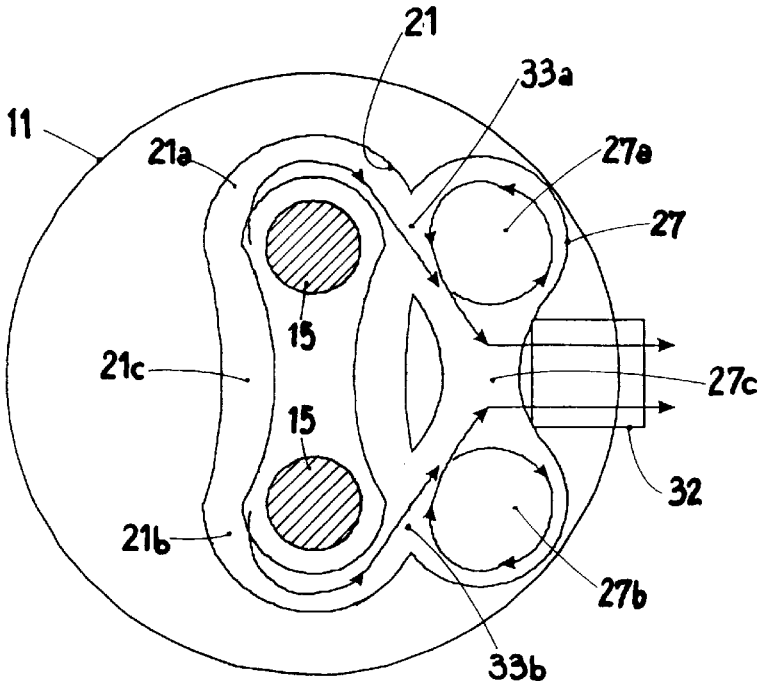
FIG. 7 is a view from above, in diagram form, of the upper part of the plugging system shown in FIG. 4 in a second form of embodiment.

According to a different embodiment, shown in FIG. 7, the inner chamber 21 is shaped so as to define two substantially cylindrical zones 21*a* and 21*b* coaxial to the two electrodes 15 and connected to each other by an intermediate zone 21*c*, while the turret 27 is shaped so as to define a first substantially cylindrical zone 27*a* and a second substantially cylindrical zone 27*b*, connected by a central zone 27*c*. In this case, the outlet collector 32 is arranged in correspondence with the central zone 27*c* while the cylindrical zones 27*a* and 27*b* are each in correspondence with an electrode 15. In this case the two volumes 21 and 27 are put into communication by means of two distinct apertures 33*a* and 33*b* of a size suitable to set off the two complementary vortexes around the two electrodes 15 by means of vortexes induced directly in the turret 27 with the appropriate median connection to the discharge collector 32. In this way two distinct vortexes are formed before the fumes exit from the furnace 11, as shown by the arrows.

It is obvious that modifications and additions may be made to the plugging system for electric arc furnaces as described heretofore, but these shall remain within the field and scope of the invention.

What is claimed is:

1. A system to plug a roof of an electric arc furnace having a main chamber arranged below the roof and at least one electrode introduced into the main chamber, the system comprising:

an auxiliary roof element arranged on the top of the roof and shaped so as to define an inner chamber and at least a central aperture through which the electrode can be moved, said auxiliary roof element comprising a plurality of pipes inside which a cooling fluid circulates under pressure, wherein the inner chamber is connected to a vertical turret with a main aspiration function suitable to create a vortex or cyclone effect at least around the upper part of the electrode.

2. The plugging system as in claim 1, wherein the inner chamber of the auxiliary roof element is separated from the main chamber by a grid of cooling pipes.

3. The plugging system as in claim 2, wherein the grid is coil-shaped to conform with the outer profile of the electrode.

4. The plugging system as in claim 1, wherein the vertical turret is provided with an aspiration system suitable to create an upward cyclone movement inside the turret, and wherein the connection between the inner chamber and the vertical turret is achieved by at least a lateral aperture suitable to induce a cyclone movement around each electrode, exploiting the ascending cyclone movement inside the vertical turret.

5. The plugging system as in claim 1, wherein the turret is arranged in a median position with respect to the electrode and wherein a collector for the outlet of the fumes is arranged tangentially with respect to the turret.

6. The plugging system as in claim 4, wherein the lateral aperture puts a central zone of the inner chamber into communication with a corresponding central zone of the vertical turret.

7. The plugging system as in claim 1, wherein at least two electrodes are provided inside the main chamber and wherein the turret is arranged in a median position with respect to the two electrodes.

8. The plugging system as in claim 7, wherein a single lateral aperture puts a central zone of the inner chamber into communication with a corresponding central zone of the vertical turret.

9. The plugging system as in claim 7, wherein the turret is shaped so as to define a first substantially cylindrical zone and a second substantially cylindrical zone, connected by a central zone, and wherein an outlet collector for the fumes is arranged in correspondence with the central zone and wherein the substantially cylindrical zones are arranged in correspondence with each of the electrodes.

10. The plugging system as in claim 9, wherein the inner chamber is shaped so as to define two substantially cylindrical zones coaxial with the two electrodes and connected by an intermediate zone, and wherein the substantially cylindrical zones of the inner chamber are connected with the substantially cylindrical zones of the vertical turret by means of two corresponding apertures which put them into communication.

11. The plugging system as in claim 1, wherein the central aperture has a much bigger section than the cross section of the electrode, to prevent the formation of discharges of the electrode onto the plurality of cooled pipes.

* * * * *